US006415472B1

(12) United States Patent
Williams

(10) Patent No.: US 6,415,472 B1
(45) Date of Patent: Jul. 9, 2002

(54) CIRCULAR EDGING TOOL FOR CONCRETE

(76) Inventor: James T. Williams, 5900 Newburg Rd., Westland, MI (US) 48185

( * ) Notice: Subject to any disclaimer, the term of this patent is extended or adjusted under 35 U.S.C. 154(b) by 0 days.

(21) Appl. No.: 09/385,552

(22) Filed: Aug. 30, 1999

(51) Int. Cl.[7] ..... B28B 17/00

(52) U.S. Cl. ..... 15/235.4; D8/10; D8/48; 425/458

(58) Field of Search ..... 15/235.4, 235.7, 15/236.07, 235.6, 235.5; D8/10, 45; 425/458

(56) References Cited

U.S. PATENT DOCUMENTS 460,645 A * 10/1891 Maurer ..... 15/235.4
1,198,133 A * 9/1916 Jennings ..... 425/458
1,347,938 A * 7/1920 Conelly ..... 15/235.4
D214,985 S * 8/1969 Davis ..... D8/45
4,766,635 A * 8/1988 DeVitis ..... 15/235.4
5,269,675 A * 12/1993 Cox ..... 15/235.7
D434,625 S * 12/2000 Denton ..... D8/45

* cited by examiner

*Primary Examiner*—Gary K. Graham
(74) *Attorney, Agent, or Firm*—Charles W. Chandler

(57) ABSTRACT

A hand tool for forming a slot between the outer cylindrical surface of a manhole frame, and the concrete in which the frame is embedded. The tool has a tool body with a bottom surface that engages the soft concrete in which the frame is embedded, and a concave lip for slidably engaging the outer surface of the manhole frame or any other circular or cylindrical object.

1 Claim, 2 Drawing Sheets

CIRCULAR EDGING TOOL FOR CONCRETE

BACKGROUND OF THE INVENTION

This invention is related to an edging tool for forming a slot around a cylindrical manhole frame and in a body of concrete in which the frame is embedded.

Manhole frames typically are made of iron with a circular opening for seating a manhole cover. The manhole frame is placed in position and then wet concrete disposed around the cylindrical outer surface of the frame. The concrete adheres to the iron frame.

Due to differences in expansion and contraction rates between the iron frame and the concrete, the concrete can rise above the top edge of the manhole. If the concrete is not properly edged, this upheaving leads to spalling and cracking, reducing the life of the concrete.

Conventional practice is to form a slot about one inch deep around the top outer edge of the cylindrical manhole frame by using a tool designed to produce a straight edge. A corner of the straight edge is inserted in the concrete and moved around the manhole frame to form the slot. This is a relatively difficult process, producing a slot having an uneven depth and uneven width.

SUMMARY OF THE INVENTION

The broad purpose of the present invention is to provide an improved edging tool for forming a slot around a circular structure such as a manhole frame, in which the slot is formed between the edge of the manhole frame and the wet concrete in which the frame has been embedded.

The preferred embodiment of the invention comprises a tool body having top and bottom surfaces. The bottom surface is intended to be placed on the top surface of the wet concrete. A handle is attached to the tool for manipulating it. An elongated concave lip extends downwardly along one edge of the tool body. The lip has a circular curvature corresponding to the outer surface of the manhole frame.

The user places the lip into the soft concrete, engaged with the outer surface of the manhole frame and then lowers the tool until the bottom surface of the tool contacts the wet concrete. He then slides the tool around the manhole frame to form a slot about one inch in depth in the wet concrete.

Such a tool provides not only a more uniform slot in the cement, but is easier and quicker for the user to finish a slot. The finished slot is esthetically pleasing and professional looking.

Still further objects and; advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views and in which.

DESCRIPTION OF THE PREFERRED EMBODIMENT

Figure 1:
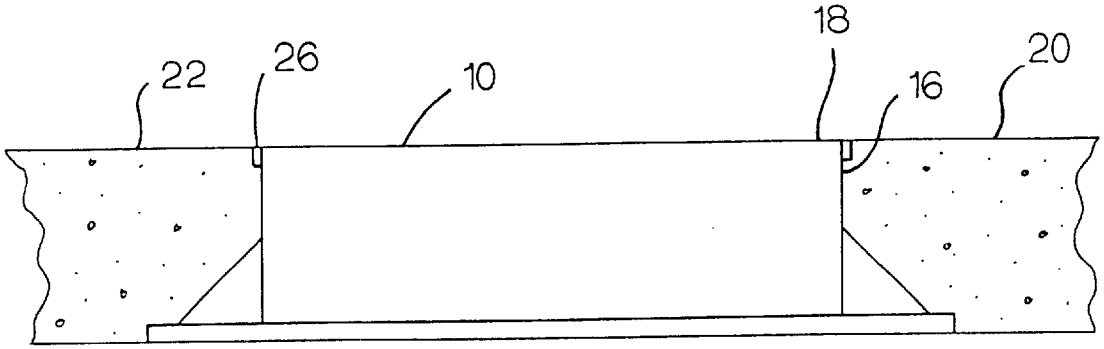
FIG. 1 is an elevational view of a manhole frame embedded in wet concrete.
Figure 2:
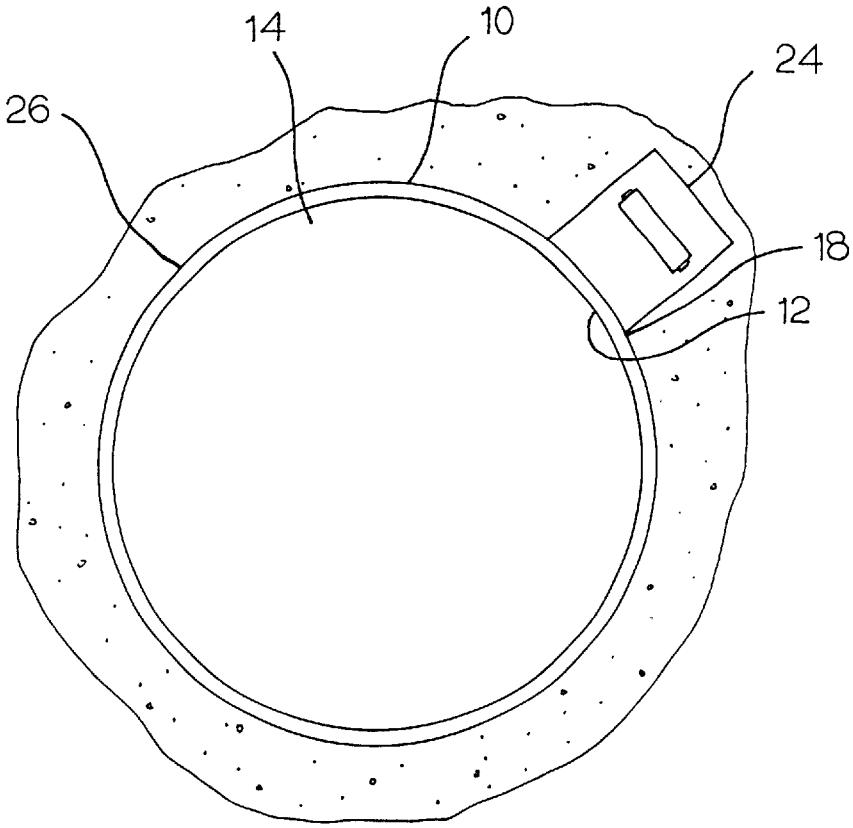
FIG. 2 is a top view of the manhole frame of FIG. 1 showing the position of a preferred edging tool.
Figure 3:
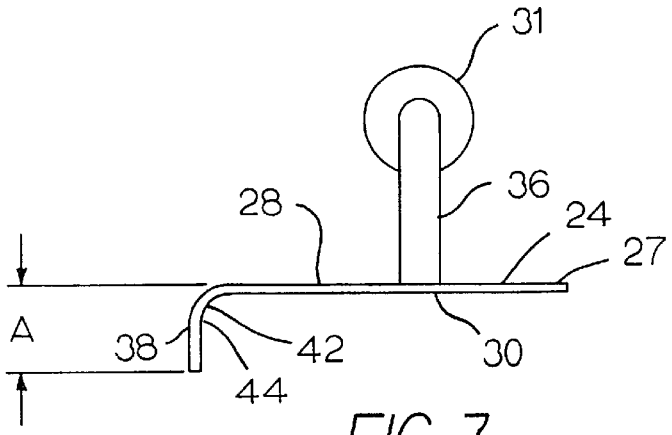
FIG. 3 is an elevational view of the tool.
Figure 4:
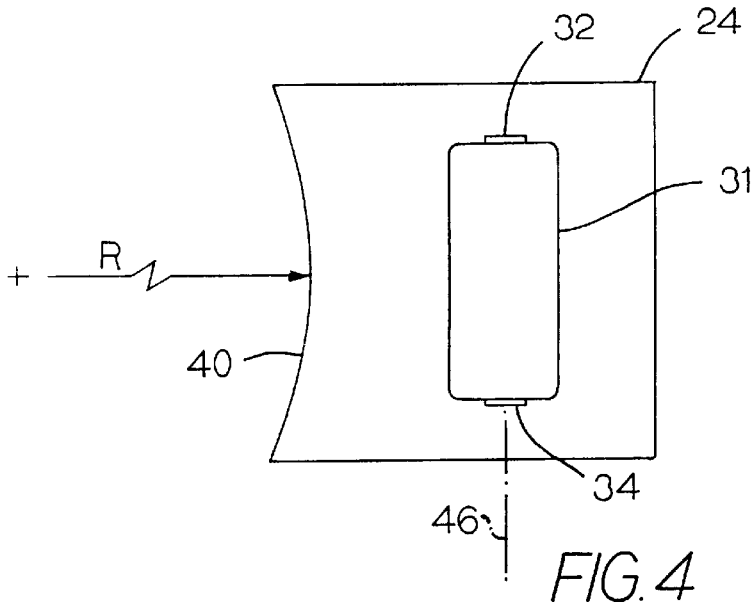
FIG. 4 is a plan view of the preferred tool.
Figure 5:
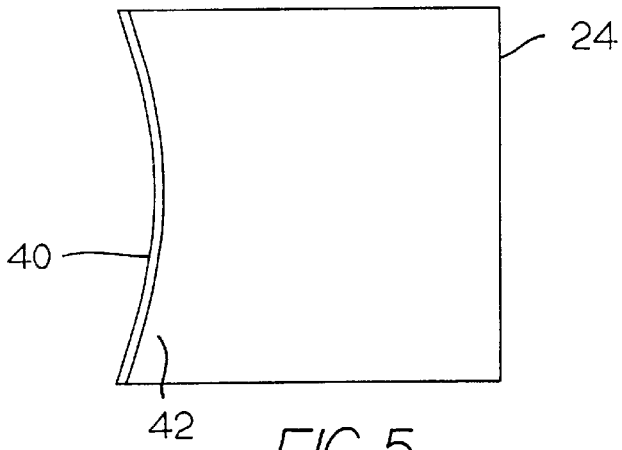
FIG. 5 is a bottom view of the preferred tool.

Referring to the drawings, a conventional iron manhole frame 10 is illustrated in FIGS. 1 and 2. Frame 10 has an inner recess 12 for seating a conventional manhole cover 14, an outer cylindrical surface 16 and a top flat annular surface 18. The manhole frame is mounted in position during the construction process, and then wet concrete 20 is deposited around and in contact with the exterior cylindrical surface of the manhole frame. The wet concrete is formed with a top surface 22 that is coplanar with the top surface 18 of the manhole frame. A tool 24, illustrating the preferred embodiment of the invention, is then employed for forming a slot 26 between the frame and the cement. Tool 24 is preferably formed of a metal plate-like body 27 having an upper surface 28 and a lower or bottom surface 30. The bottom surface of the body, is intended to slidably engage the top surface 22 of the concrete.

An elongated handle 31 has its ends 32 and 34 supported by a bracket 36 that is attached to the top surface of the tool body. A lip 38 has a concave outer surface 40 about the length of the tool. The lip has a suitable depth "A " depending downwardly from the bottom surface of the body. The body and the lip each has a thickness in conformance with usual industry standards.

Curved edge 42 connects the surface 44 of the lip and bottom surface of the body. Curved edge 42 has a one-quarter inch radius.

The concave outer surface of the lip is formed about a radius line "R" that corresponds to the radius of the outer cylindrical surface of the frame, that is twenty-three inches or other suitable sizes. The body and the lip are formed of a rigid material, preferably a steel material. Plastic may also be suitable.

The handle is preferably about four and one-half inches in diameter and six inches in length, and is formed along an axis 46 that is at right angles to the radius line R forming the outer surface of the lip. The handle is similar to that of a standard concrete finishing tool.

Referring to FIG. 2, the user inserts the lip into the concrete until the bottom surface of the body engages the top surface of the wet concrete, and the lip engages the manhole frame. He advances the tool so that the lip slidably engages the manhole frame, completely around the frame to form slot 26.

The preferred tool not only is a quicker, more precise way of forming the slot but also provides a much more uniform slot, in both depth and width.

Having described my invention, I claim:

1. A concrete edging tool for forming a slot around a circular outer edge of a manhole frame or other circular objects, comprising:

a tool body having a generally flat rigid bottom surface defining a plane, said bottom surface for engaging a generally flat top surface of a body of soft concrete partially encasing a manhole frame having a top surface and a cylindrical border formed around a center, and in which the flat top surface of the body of soft cement is generally co-planar with the top surface of the manhole frame;

the tool body having an elongated rigid lip extending downwardly from said bottom surface;

said lip and tool body being formed with substantially the same thickness over their extent;

the lip having an outer concave surface that generally corresponds with the cylindrical border of the manhole frame;

the concave outer surface of the lip being formed about an axis that is normal to the plane of the flat bottom surface and which passes through a center axis of the cylindrical border; and an elongated handle attached to the tool body and disposed with a longitudinal axis at an angle that is generally transverse to a radial line extending from a center of the outer surface of the lip, said handle extending substantially parallel to said plane.

* * * * *